US006116874A

United States Patent [19]

Nation et al.

[11] Patent Number: 6,116,874

[45] Date of Patent: Sep. 12, 2000

[54] GAS COMPRESSORS

[75] Inventors: Toby James Nation, Warmley; Gary Peter Brown, Kingswood; Martin Selway, Steyning; John McCouch, Bradley Stoke; Jeremy James Durrant, Longwell Green, all of United Kingdom

[73] Assignee: Knorr-Bremse Systems for Commercial Vehicles Limited, Bristol, United Kingdom

[21] Appl. No.: 09/120,297

[22] Filed: Jul. 22, 1998

[30] Foreign Application Priority Data

| | | | |
|---|---|---|---|
| Jul. 26, 1997 | [GB] | United Kingdom | 9715741 |
| Jul. 26, 1997 | [GB] | United Kingdom | 9715743 |
| Jul. 26, 1997 | [GB] | United Kingdom | 9715745 |
| Apr. 6, 1998 | [GB] | United Kingdom | 9807236 |

[51] Int. Cl.[7] ..... F04B 39/10; F12K 15/00

[52] U.S. Cl. ..... 417/571; 137/512

[58] Field of Search ..... 417/571, 569, 417/559, 524; 137/512.15, 512, 512.1, 858

[56] References Cited

U.S. PATENT DOCUMENTS

| | | |
|---|---|---|
| 2,043,849 | 6/1936 | Bixler . |
| 2,151,746 | 3/1939 | Cody . |
| 2,852,184 | 9/1958 | Stolte . |
| 3,986,798 | 10/1976 | Lindell et al. . |
| 4,193,424 | 3/1980 | Hrabal . |
| 5,265,646 | 11/1993 | Richardson . |
| 5,266,016 | 11/1993 | Kandpal . |
| 5,454,397 | 10/1995 | Miszczak . |
| 5,456,287 | 10/1995 | Leu . |
| 5,558,508 | 9/1996 | Sesano et al. . |
| 5,603,611 | 2/1997 | Tarutani et al. . |
| 5,860,800 | 1/1999 | Kramer et al. . |

FOREIGN PATENT DOCUMENTS

| | | |
|---|---|---|
| 372 154 B1 | 6/1990 | European Pat. Off. . |
| 494590A1 | 7/1992 | European Pat. Off. . |
| 571 715 A1 | 12/1993 | European Pat. Off. . |
| 705 977 A1 | 6/1996 | European Pat. Off. . |
| 7200686 | of 0000 | Germany . |
| 1 129 784 | 5/1962 | Germany . |
| 1142478 | 1/1963 | Germany . |
| 6946784 | 11/1969 | Germany . |
| 1957668 | 5/1971 | Germany . |
| 2410705 | 9/1975 | Germany . |
| 2733089 | 2/1979 | Germany . |
| 3305791 A1 | 8/1984 | Germany . |
| 3813539C2 | 11/1988 | Germany . |
| 3909531A1 | 6/1990 | Germany . |
| 3940099A1 | 6/1991 | Germany . |
| 4125123A1 | 2/1992 | Germany . |
| 19535079 | 4/1996 | Germany . |
| 59-208181 | 11/1984 | Japan . |
| 992232 | 3/1962 | United Kingdom . |
| 1132506 | 11/1968 | United Kingdom . |
| 1409589 | 10/1975 | United Kingdom . |
| 2018364 | 10/1979 | United Kingdom . |
| 2044365 | 10/1980 | United Kingdom . |
| 2083566 | 3/1982 | United Kingdom . |
| 2 165 317 | 4/1986 | United Kingdom . |
| 2171465 | 8/1986 | United Kingdom . |
| 2208 180 | 3/1989 | United Kingdom . |
| 2319569 | 5/1998 | United Kingdom . |

*Primary Examiner*—Teresa Walberg
*Assistant Examiner*—Daniel Robinson
*Attorney, Agent, or Firm*—Barnes & Thornburg

[57] ABSTRACT

In a piston and cylinder gas compressor having a cylinder block, a valve plate and a cylinder head the sealing means between the cylinder head and the valve plate is designed to constrain the delivered air and/or coolant fluid to flow in an extended fluid flow path to enhance the heat flow from the delivered air before arrival at a delivery port.

12 Claims, 5 Drawing Sheets

GAS COMPRESSORS

BACKGROUND AND SUMMARY OF THE INVENTION

The invention relates to gas compressors and relates more especially to a piston and cylinder compressor.

Piston and cylinder compressors are known which include a valve plate located between a cylinder and a cylinder head said cylinder head having an inlet port and a delivery port and said valve plate having induction and delivery passages with respective valves operable to close the delivery passage during gas induction strokes of the piston and to close the induction passage during gas delivery strokes, the compressor including first sealing means providing sealing between the valve plate and the cylinder and second sealing means providing sealing between the valve plate and the cylinder head.

The object of the present invention is to provide a piston and cylinder compressor which has improved cooling of delivered compressed gas.

According to the present invention there is provided a piston and cylinder gas compressor including a valve plate located between the cylinder and a cylinder head said cylinder head having an inlet port and a delivery port and said valve plate having induction and delivery passages with respective valve means operable to close the delivery passage during gas induction strokes of the piston and to close the induction passage during gas delivery strokes, the compressor including first means providing sealing between the valve plate and the cylinder and second means providing sealing between the valve plate and the cylinder head and being characterised in that the second sealing means incorporates means which provides an extended flow path for the flow of compressed gas from the delivery passage to the delivery port and/or for the flow of liquid coolant between a liquid inflow port and a liquid outflow port.

In order that the invention may be more clearly understood and readily carried into effect the same will be further described by way of examples with reference to the accompanying drawings with.

DESCRIPTION OF THE PREFERRED EMBODIMENTS

Figure 1:
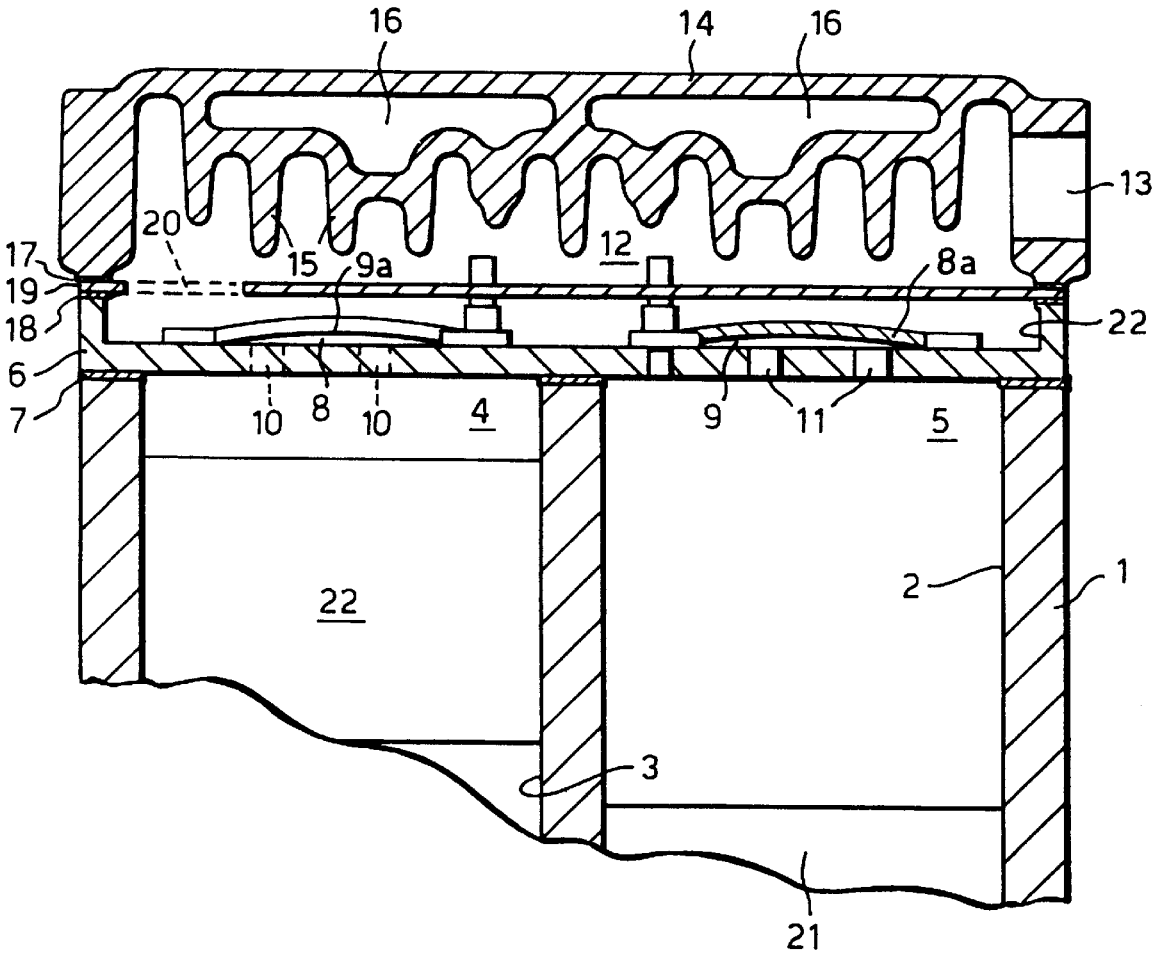
FIG. 1 illustrates a schematic fragmental sectional view of a twin cylinder air cooled compressor.

Referring to FIG. 1 an air compressor includes a crankcase and cylinder body 1 having two cylinder bores 2 and 3 within which respective pistons 21,22 are operable by a crankshaft (not shown) to cyclically induce and compress air drawn into compression chambers 4 and 5. The upper end of the cylinder body is sealingly closed by a valve plate and first sealing means comprising a gasket 7. The valve plate 7 carries inlet reed-valves (not shown) for both cylinders. A recess 22 of the upper side of the valve plate accommodates delivery reed valves 8 and 9 having retaining bridges represented at 8*a* and 9*a* which cover delivery passages 10 and 11 from the respective cylinders for air flow into the delivery air chamber 12 and common delivery port 13 in the cylinder head 14. The cylinder head 14 is of good thermally conductive aluminium or alloy thereof and has internal air cooling fins 15 and adjacent liquid coolant galleries 16 for conveying heat away from the head. Between the cylinder head 14 and the valve plate a second sealing means comprises two gaskets 17 and 18 together with an additional plate 19 between them and an aperture 20 at a position remote from the delivery port 13.

In operation of the compressor, the pistons 21 and 22 reciprocate to alternatively compress induced air in chambers 4 and 5 and by virtue of the additional plate 19 and the aperture 20 thereof compressed air delivered via reed valves 8 and 9 is drawn across the underside of the plate 19, through aperture 20 and is additionally cooled by fins 15 before reaching the delivery port 13. The delivered compressed air at port 13 is therefore cooler than would be the case if the second sealing means comprising 17, 18 and 19 permitted such air to be delivered more directly from the delivery reed valves to the delivery port.

Figure 2:
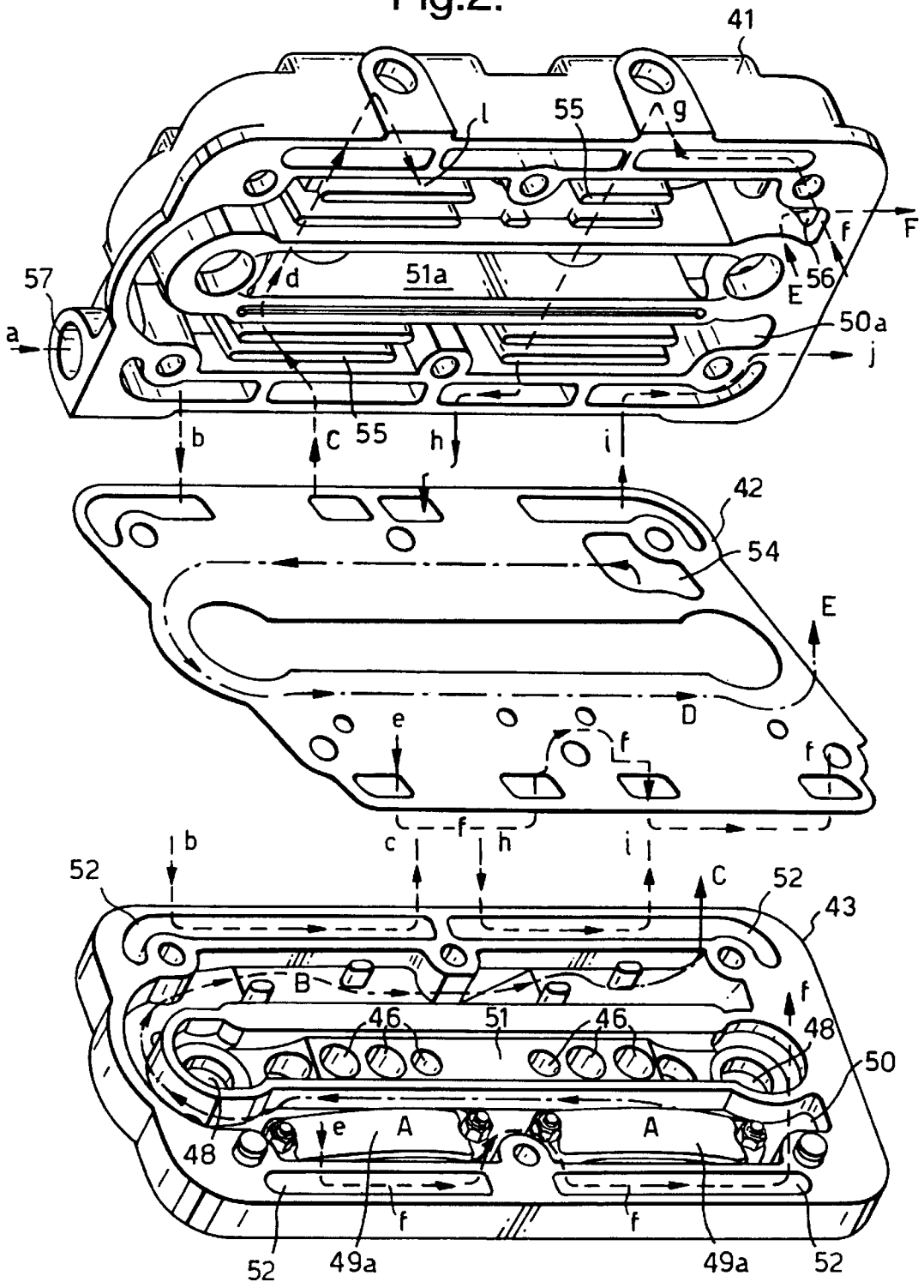
FIG. 2 illustrates in three-dimensional manner a cylinder head and valve plate components of a liquid cooled twin cylinder compressor.
Figure 3:
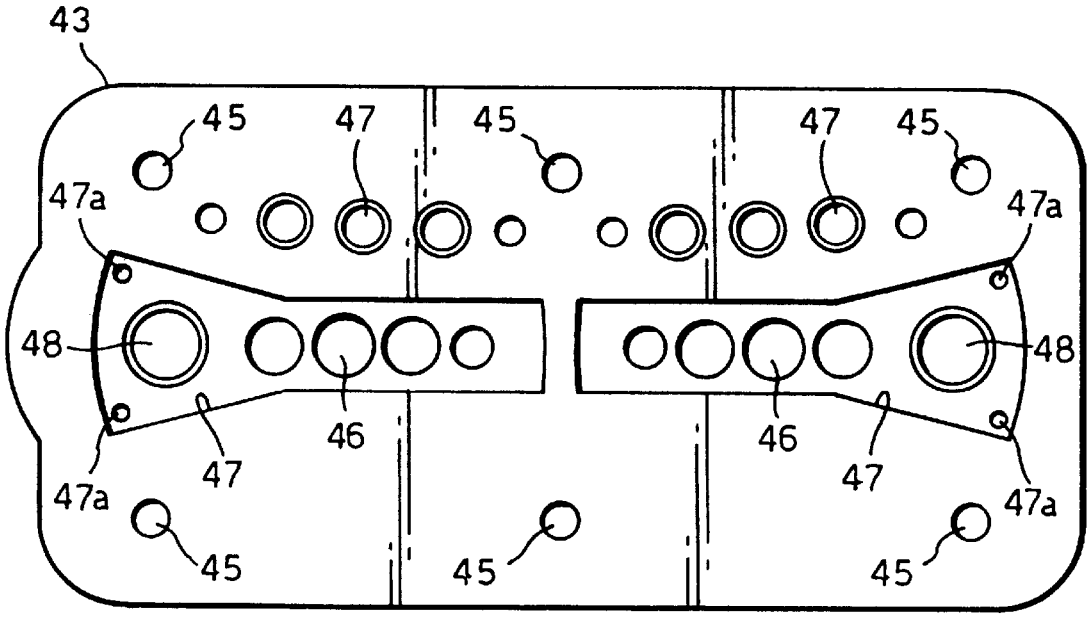
FIG. 3 illustrates the under-side of the valve plate of FIG. 2
Figure 3A:
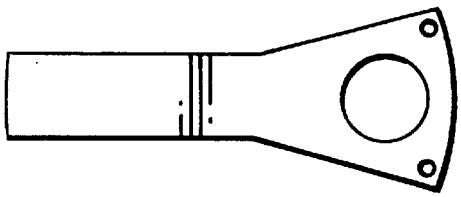
FIG. 3*a* is a plan view of an inlet valve reed

Referring to FIG. 2 components of the compressor shown therein in three dimensions comprise a water cooled cylinder head 41 of a twin cylinder compressor, a cylinder head gasket 42 and valve plate 43. The cylinder head 41 and the valve plate 43 are manufactured as aluminium castings and the gasket 42 is of a suitably elastomer coated ferrous metal. An under-side plan view of the valve plate is shown in FIG. 3 from which it is observed that the valve plate has six cylinder head clamping bolt holes 45, four valved air inflow passages 46 for each cylinder of the compressor and three air delivery flow passages 47. Respective flat springy metal inlet valve reeds, one such being shown in FIG. 3*a*, are accommodated in recesses 47 with locating pegs 47*a*, the configuration being similar to that described in the Specification of U.K. Patent Application No. 9715741.6 (K-621). Moreover these respective reeds also have apertures which provide direct communication from holes 48 of the valve plate which house unloader valves (not shown) for the respective compressor cylinders, as described more especially in the Specification of European Patent No. 0240278.

Reverting to FIG. 2 the top side of the valve plate has a plurality of recesses. The respective delivery reed valves are captive beneath reed bridges 49*a*, these reeds permitting one-way air flow into a U-shaped delivery air gallery 50 formed by a recess which has adjoining regions on either side of an inlet air gallery 51 above apertures 46. The valve plate also has four distinct channels 52 formed by recesses through which coolant is arranged to flow via the gasket 42 from the cylinder head.

The gasket 42 is provided with opposed sealing surfaces for sealing in known manner between the valve plate and the cylinder head and is provided with apertures not merely to permit induction and delivery air flow directly to or from the respective reed valves but the gasket is provided with selectively positioned apertures which result in extended flow paths for delivered compressed air. Such extended flow passages are also provided for the flow of cooling water through the cylinder head and the valve plate 43.

Referring to the cylinder head 41, a generally centrally positioned elongate chamber 51*a* has an inlet port (not shown) and joins via the gasket 42 with the chamber 51 of the valve plate 43. Unloader valve ports such as 48*a* also communicate with the chamber 51*a* in operation. Similarly to 50 of the valve plate, a generally U-shaped air delivery chamber 50*a* is defined above the chamber 50 of the valve plate communication between 50 and 50*a* being restricted to flow via an aperture 54 of the gasket. The chamber 50*a* has a plurality of downward projecting internal cooling fins such as 55 over which delivery air flows before reaching the delivery port 56.

In operation of the compressor, air is drawn into the respective cylinders in turn via the inlet valve reeds in gallery 50 during respective induction strokes and driven outwards in turn via the delivery reed valves past the bridges 49*a*. The flow path for such air under compression is constrained by the gasket 42 to follow an extended flow path from the delivery valves as indicated by the broken line and denoted A.B,C,D,E,F. This passes from the delivery valves at A through the generally U-shaped path in chamber 50, namely beneath the gasket 47, from whence it passes via aperture 54 therein to return along the generally U-shaped path provided in chamber 51*a*, namely above the gasket, and past fins 55 to F at the delivery port 56. cooling of the delivered air is thereby optimized by such an extended delivery flow path having a U-shaped configuration both below and above the second cooling means comprising gasket 42.

Cooling of the cylinder head is also advantageously provided in enhanced manner by pumped liquid coolant, preferably frost protected water and inhibitor, which enters the head at coolant inlet port 57 and follows an arrowed flow path a, b, c, d, e, f, g, h, i, j to the coolant outlet port (not shown). By selective provision of coolant flow apertures of the gasket and of distinct channels or recesses 52 of the valve plate the coolant is constrained to flow via such circuitous path which avoids short-cuts and optimises the thermal transfer form the cylinder head per liter flow rate.

In the embodiments of air cooled or water cooled gas compressors described in the foregoing in FIG. 1 and FIG. 2, gas delivery valve reeds are accommodated in recesses provided in the upper surface of a valve plate whereby the second sealing means, namely the second sealing means, between the valve plate is designed to restrict the flow of delivered air and or coolant water in such a way as to extend the respective flow paths. If such recesses are reduced in depth or eliminated such that in the limit the valve plate has an entirely flat upper surface, the second cooling means may be formed with upwardly projecting regions which extend sufficiently into the cylinder head to accommodate the or each delivery valve reed assembly and also provide advantageous extended fluid delivery flow paths. The embodiments of FIG. 4 and FIG. 5 of liquid single cylinder compressors in accordance with the invention employs this concept.

Figure 4:
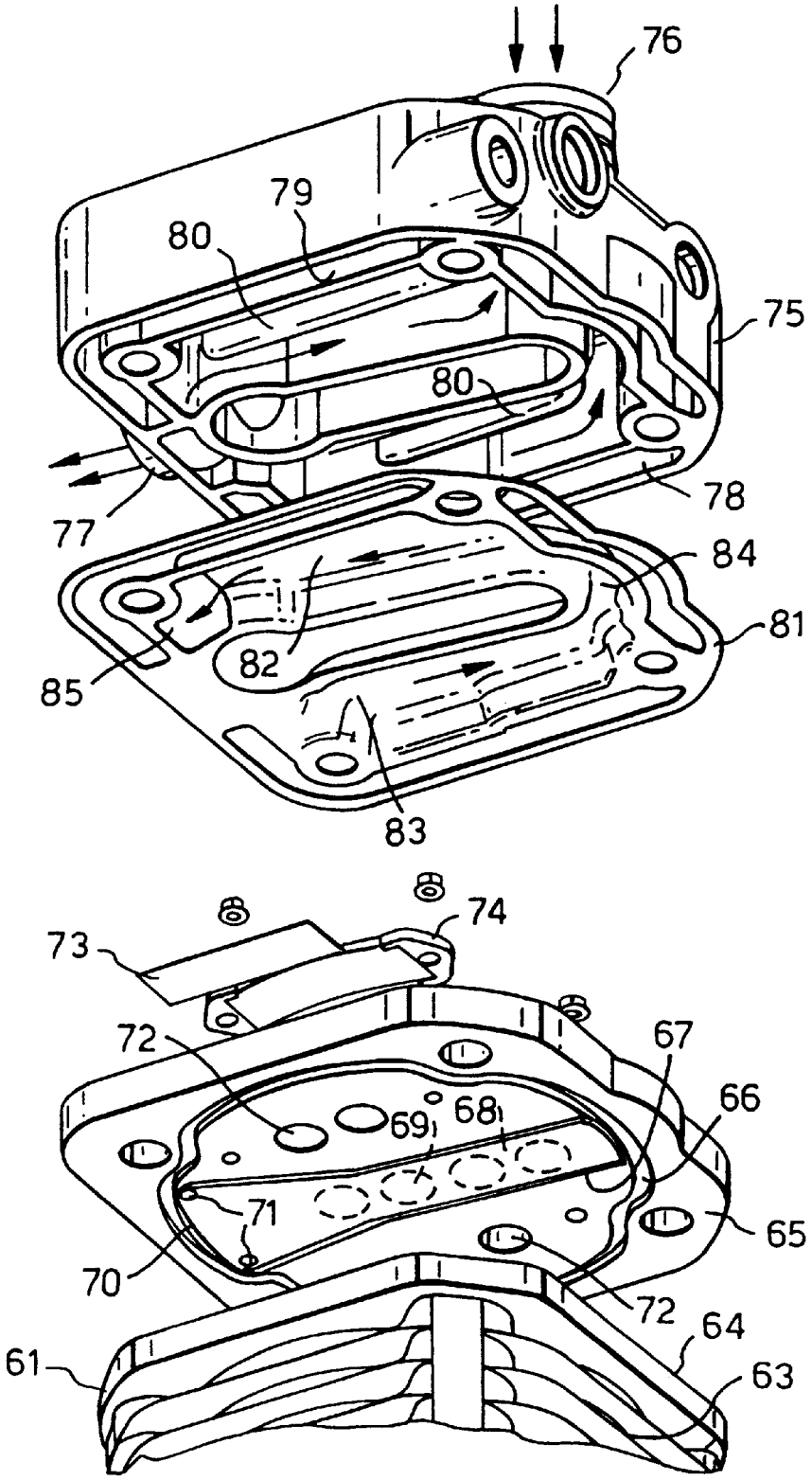
FIG. 4 illustrates an exploded view of parts of another embodiment of a single cylinder compressor and FIG. 5 illustrates an exploded view of parts of another embodiment of a single cylinder compressor.

Referring to FIG. 4, the cylinder denoted by reference 61 has cooling fins 63 and a top face 64 which sealingly receives a valve plate 65, sealing with surface 64 being provided by a thermally stable O-ring seal located in a groove 66. The valve plate 65 has a shallow recess 67 which receives a downwardly deflectable spring metal planar valve reed 68 which covers four induction through-passages 69. The reed 68 has an end 70 retained between the valve plate 65 and the cylinder top end surface 64 and located laterally in the valve plate by hard metal pins (not shown) in holes 71. The valve plate also has delivery through-passages 72 located to either side of the induction through-passages covered by respective deflectable planar metal delivery valve reeds such as 73 retained by arresters such as 74 mounted to the upper surface of the valve plate 65.

The compressor has a cylinder head 75 which carries dividing walls and an induction air inlet port 76 and a delivery air outlet port 77. The head also incorporates water cooling channels 78 and 79 and integral cooling fins 80 within the delivery air flow path. The cylinder head 65 is bolted with the intermediary of a rubber-coated metal gasket 71, sealingly and the valve plate 65. In the present example, long bolts (not shown) extend through the cylinder head, gasket, valve plate and into cylinder 61 the (not shown) crank case of the compressor.

In accordance with the invention, the gasket 81 is not entirely planar as it is formed with three-dimensionally shaped regions 82 and 83 which project upwards into chambers or recesses of cylinder head 75 which lie in delivery air flow paths from the delivery valves to the delivery port 77.

As shown, the shaped regions 82 and 83 of the gasket 81 are interconnected at 84 and 82 has an opening 85 into the respective delivery air recess of the cylinder head. The shaped regions of the gasket come into close proximity with downward projecting internal cooling fins integral with the cylinder head to assist the distribution of delivery air flow between cooling surfaces of the fins.

In operation, the compressor functions in a mainly conventional manner, drawing air during induction strokes via port 76, through the induction passage past the downwardly deflected valve reed 8 and during compression strokes air under pressure from the compression chamber of the compressed air passes through delivery passages 72, and past unseated delivery valve reeds 73 into the shaped regions 82 and 83 at the lower side of the gasket 81. These regions thereby provided extended flow pith length for the delivered air as illustrated by the arrows. By virtue of these extended flow paths and distribution between cooling fins, air which is at a relatively high temperature on emerging from the delivery reed valve is afforded enhanced opportunity to give up heat to the water cooled walls and internal fins of the cylinder head before delivery. Such enhanced cooling opportunity is provided without providing significant added mass or overall physical dimensions to a compressor.

As the compressor described with reference to FIG. 4 is liquid-cooled, the gasket may be designed with selectively located upward projecting regions and apertures which constrain the flow path of liquid coolant to an extended path, similarly to the arrangement detailed in the twin cylinder compressor of FIG. 2, such upward projections performing functions similar to the recesses 52 of FIG. 2. Alternatively, recesses such as 52 with which apertures of the gasket cooperate may be provided if desired.

Of course, the invention may be applied if required to provide extended flow paths solely of the liquid coolant of a liquid cooled compressor.

Figure 5:
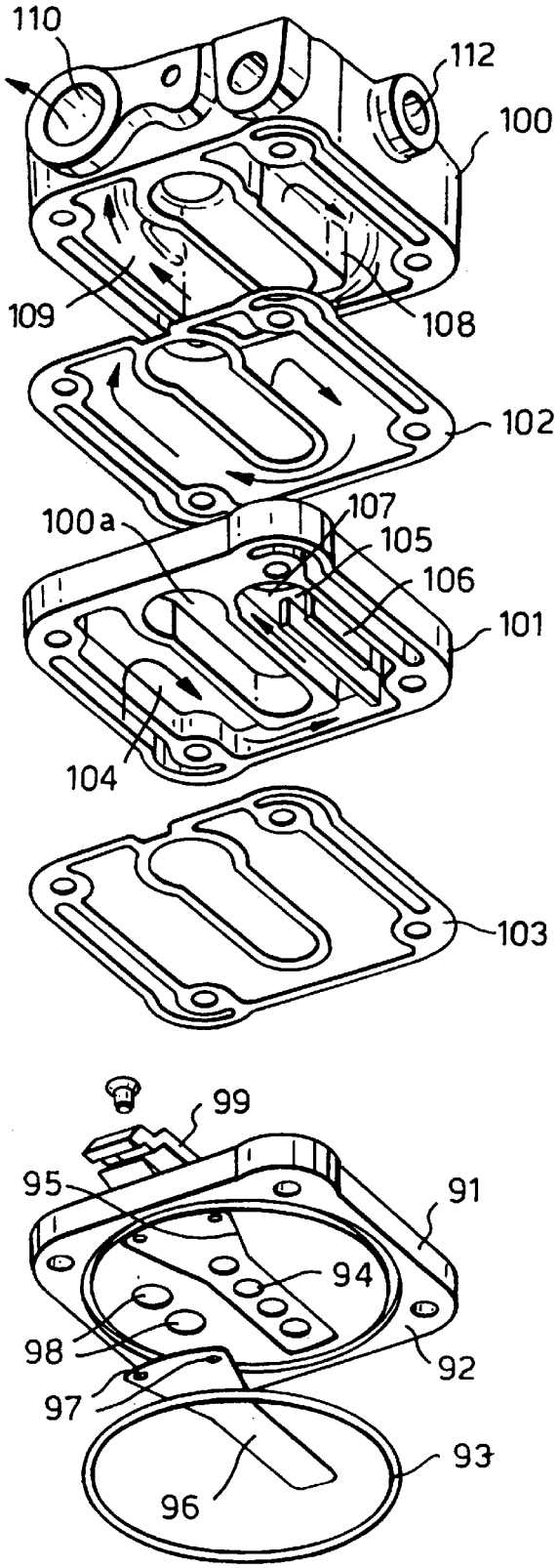

Referring to FIG. 5 of drawings, a single cylinder gas compressor comprises a crankcase, piston and cylinder which are conventional and therefore not shown. The present compressor has a valve plate denoted by reference 91 which carries an annular groove 92 to contain an O-ring 93 for sealing between the under surface of the valve plate and the abutting open end face of the cylinder (not shown). The valve plate has induction air passages 94 in a recessed area 95 which accommodates a springy flat metal lamina induction valve reed 96 as disclosed above with reference to FIG. 3*a*. The reed 96 is supportable in position between the plate 91 and the said end face of the cylinder and located in position relative to the valve plate by hard metal pins (not shown) engaging apertures 97. The valve plate also has delivery passages 98 communicating with a single delivery reed valve assembly 99 attached to the upper surface of the valve plate 91. The valve plate is sealingly secured to the cylinder by bolts (not shown) which secure the liquid cooled cylinder head 100 and the second sealing means namely between the valve plate and the cylinder head comprises an intermediate liquid cooled cooling plate 101 with respective gaskets 102 and 103. Cooling plate 101 has a central aperture 100*a* for induction air flow to the apertures 94. Plate 101 is also of sufficient thickness to accommodate the delivery reed valve assembly 99 within a recess region 104 of its under side. This recess communicates with a further recess region 105 including cooling fins 106 via which delivery air can flow towards an aperture 107 and through to a receiving region 108 of the cylinder head communicating with a further receiving region 109, each receiving region having cooling fins in the path of delivery air towards the air delivery port 51 of the cylinder head.

In operation of the compressor of FIG. 5, a downward induction stroke of the piston in the cylinder draws air via induction port 112 of the cylinder head 39 and through central aperture 40*a* and passages 94 of the downwardly deflecting induction valve reed 96 into the cylinder. During such induction stroke the delivery reed valve 99 is of course closed but reopens during the next compression stroke when air is driven under pressure via the delivery apertures 98. From the delivery reed valve the delivered air passes via recesses 104 and 105 of the valve plate and then upwards via aperture 107 to the interconnected receiving recesses 108 and 109 in turn as shown by the arrows in the upper gasket, on its way to the delivery port 110.

By virtue of the described arrangement of FIG. 5 wherein all delivery air passes over internal cooling surfaces of the compressor over a prolonged time, efficient cooling is achieved without the substantial additional cost and space required by external cooling means for delivered compressed air.

Other embodiments and modifications of compressors in accordance with the invention wherein sealing means between a valve plate and a cylinder head affords extended fluid flow of delivered air and/or liquid coolant will now be envisaged by persons skilled in the art.

What is claimed is:

1. A piston and cylinder gas compressor including a valve plate located between a cylinder and a cylinder head, said cylinder head having an inlet and a delivery port and said valve plate having induction and delivery passages with respective induction and delivery valve means operable to close the delivery passage during gas induction strokes of the piston and to close the induction passage during gas delivery strokes, the compressor including first sealing means providing sealing between the valve plate and the cylinder and second sealing means providing sealing between the valve plate and the cylinder head and being characterized in that the second sealing means incorporates a third means which provides an extended flow path for the flow of compresses gas from the delivery passage generally alone the valve plate below the third means before passing into the cylinder head and generally along the cylinder head above the third means to the delivery port and the flow path above and/or below the third means is a generally U-shaped flow path.

2. A compressor as claimed in claim 1, characterised in that regions of said U-shaped flow path extend along opposed sides of an induction gas flow region.

3. A compressor as claimed in claim 2 characterised in that the said second sealing means comprises a flat gasket and said delivery valve means are accommodated in a recess of the valve plate.

4. A compressor as claimed in claim 2, characterised in that said second sealing means comprises a gasket with a three-dimensionally shaped region which projects into a delivery region of the cylinder head.

5. A compressor as claimed in claim 1 characterised in that the said second sealing means comprises a flat gasket and said delivery valve means are accommodated in a recess of the valve plate.

6. A compressor as claimed in claim 1 characterised in the said second sealing means comprises a gasket with a three-dimensionally shaped region which projects into a delivery region of the cylinder head.

7. A liquid cooled compressor as claimed in claim 1 characterised in the said second sealing means has a gasket and said valve plate has recesses which cooperate with apertures of the gasket to provide an extended flow path for coolant liquid.

8. A liquid cooled gas compressor as claimed in claim 1 characterised in that said sealing means is a gasket with a three-dimensionally shaped region which projects into a coolant flow region of the cylinder head which cooperates therewith to provide extended flow passage for coolant liquid.

9. A piston and cylinder gas compressor including a valve plate located between a cylinder and a cylinder head, said cylinder head having an inlet and a delivery port and said valve plate having induction and delivery passages with respective induction and delivery valve means operable to close the delivery passage during gas induction strokes of the piston and to close the induction passage during gas delivery strokes, the compressor including first sealing means providing sealing between the valve plate and the cylinder and second sealing means providing sealing between the valve plate and the cylinder head and being characterized in that the second sealing means incorporates a third means which cooperates with the valve plate and/or the cylinder head to provided an extended flow path for the flow of liquid coolant from a liquid inflow port to a liquid outflow port.

10. A liquid cooled compressor as claimed in claim 9 characterised in that said second sealing means has a gasket and said valve plate has recesses which cooperate with apertures of the gasket to provide an extended flow path for coolant liquid.

11. A liquid cooled gas compressor as claimed in claim 9 characterised in that said second sealing means is a gasket with a three-dimensionally shaped region which projects into a coolant flow region of the cylinder head which cooperates therewith to provide extended flow passage for coolant liquid.

12. A compressor as claimed in claim 9 characterized in that said flow path continues generally along the cylinder head above the third means before reaching the delivery port.

* * * * *